US010876335B2

(12) United States Patent
Byun

(10) Patent No.: US 10,876,335 B2
(45) Date of Patent: Dec. 29, 2020

(54) MULTI-LINK HINGE DEVICE

(71) Applicants: EPTECH CO., LTD., Gyeonggi-do (KR); Chun ho Byun, Gyeonggi-do (KR)

(72) Inventor: Chun ho Byun, Gyeonggi-do (KR)

(73) Assignees: Chun ho Byun, Gyeonggi-do (KR); EPTECH CO., LTD., Gyeonggi-do (KR)

( * ) Notice: Subject to any disclaimer, the term of this patent is extended or adjusted under 35 U.S.C. 154(b) by 0 days.

(21) Appl. No.: 16/657,034

(22) Filed: Oct. 18, 2019

(65) Prior Publication Data

US 2020/0131830 A1 Apr. 30, 2020

(30) Foreign Application Priority Data

Oct. 24, 2018 (KR) ..... 10-2018-0127659

(51) Int. Cl.
*E05D 11/00* (2006.01)
*E05D 3/16* (2006.01)
*E05F 3/20* (2006.01)

(52) U.S. Cl.
CPC ..... *E05D 11/0054* (2013.01); *E05D 3/16* (2013.01); *E05D 2011/0072* (2013.01); *E05F 3/20* (2013.01); *E05Y 2800/41* (2013.01); *E05Y 2900/20* (2013.01); *E05Y 2900/30* (2013.01); *E05Y 2900/31* (2013.01)

(58) Field of Classification Search
CPC ..... E05D 11/0054; E05D 2011/0072; E05D 3/16; E05Y 2800/41
See application file for complete search history.

(56) References Cited

U.S. PATENT DOCUMENTS 5,791,016 A * 8/1998 Lenz ..... E05D 5/0246 16/258
6,308,376 B1 * 10/2001 Koshikawa ..... E05D 3/16 16/250
6,374,459 B1 * 4/2002 Zetti ..... E05D 3/16 16/286
7,987,558 B2 * 8/2011 Beckmann ..... E05D 11/0054 16/366
8,321,996 B2 * 12/2012 Hirtsiefer ..... E05D 15/46 16/286
8,978,205 B2 * 3/2015 Kim ..... E05D 11/0054 16/251
2017/0241176 A1 * 8/2017 Zetti ..... E05F 1/1261
2017/0306680 A1 * 10/2017 Zetti ..... E05F 5/10
2019/0292834 A1 * 9/2019 Lee ..... E05D 3/16
2019/0383081 A1 * 12/2019 Thielmann ..... E05D 11/0054

FOREIGN PATENT DOCUMENTS

AU 2007291477 3/2008
KR 20070101298 A 10/2007
KR 20090061643 A 6/2009
KR 101715301 B1 3/2017

* cited by examiner

*Primary Examiner* — Jeffrey O'Brien
(74) *Attorney, Agent, or Firm* — Millen, White, Zelano & Branigan, P.C.; William Nixon

(57) ABSTRACT

An embodiment of the present invention provides a multi-link hinge device in which any one of a plurality of links connecting a plurality of levers to each other may serve as a link and at the same time serve as a cover, thereby preventing a finger or the like from being caught in a space between the plurality of levers in advance when the door is opened or closed.

13 Claims, 10 Drawing Sheets

(b)

(a)

MULTI-LINK HINGE DEVICE

TECHNICAL FIELD

The present invention relates to a multi-link hinge device, and more particularly, to a multi-link hinge device that is capable of easily opening and closing a door of a member such as a household appliance, furniture, and the like in a narrow space.

BACKGROUND

In general, members such as the household appliance, furniture, and the like may be provided with a main body and a door hinged to the main body to open and close the main body, wherein the main body may be opened and closed as the door is rotated.

By way of example, describing a refrigerator as one of a plurality of members, the related prior art is disclosed in Korean Utility Model Publication No. 20-1999-0035936, entitled "HINGE OF DOOR FOR REFRIGERATOR".

However, as the refrigerator increases in size, the size of the door also increases, and accordingly, with respect to the main body, the range of rotation of the door also increase. As a result, there is a problem that a limitation of the installation space of the refrigerator occurs. Accordingly, in order to reduce the space required for opening and closing the door, there is an increasing need for a hinge that can reduce a rotation space of the door when the door is rotated.

SUMMARY

In view of the above, an embodiment of the present invention provides a multi-link hinge device in which any one of a plurality of links connecting a plurality of levers to each other may serve as a link and at the same time serve as a cover, thereby preventing a finger or the like from being caught in a space between the plurality of levers in advance when the door is opened or closed.

In accordance with an embodiment of the present invention, there is provided a multi-link hinge device, which includes: a bottom lever installed on a main body of a member provided with a door, the bottom lever having a first bottom fastening hole and a second bottom fastening hole spaced apart from each other at an end side thereof; a top lever installed on the door of the main body, the top lever having a first top fastening hole and a second top fastening hole spaced apart from each other; a body lever having one end connected to the first bottom fastening hole and having a first body fastening hole formed at the other end and a second body fastening hole formed at an inner side thereof; a first link pivotally connected to the first top fastening hole and the first body fastening hole; a second link pivotally connected to the second top fastening hole and the second body fastening hole and having a link center fastening hole formed therein; and a third link pivotally connected to the link center fastening hole and the second bottom fastening hole, wherein the second link is pivotally connected to the second top fastening hole and the second body fastening hole outside the top lever and the body lever, and is formed to have a predetermined size so as to cover an area spaced from the first link from the outside.

In an embodiment of the multi-link hinge device, the second link is formed in a polygonal shape so as to cover the area between the top lever, the body lever and the first link continuously as the door moves from an open position to a closing position.

In a further embodiment, the multi-link hinge device further includes: a rocker arm installed between the top lever and the first link and guiding the top lever to move to a closing position or an open position along a constant velocity section and an acceleration section when the top lever opens and closes the door.

In an embodiment of the multi-link hinge device, the rocker arm includes: a main body coupled to the first link and having a receiving area therein; a roller member protruding from an end of the main body to press a cam member provided in the body lever; and a pressing member connected to the roller member, the pressing member being provided in the receiving area to accommodate an elastic member, and the roller member being provided to elastically press the cam member.

In an embodiment of the multi-link hinge device, the cam member is fixedly coupled to the body lever such that an area facing the roller member is changed into a constant velocity section or an acceleration section as an angle of the first link with respect to the body lever is varied.

In an embodiment of the multi-link hinge device, the rocker arm includes: an adjusting screw portion coupled to surround the upper and lower surfaces of the main body so as to be rotatable, and configured to restrict a movement in a lifting direction; a fastening portion coupled to the adjusting screw portion and positioned in the main body by penetrating the adjusting screw portion in a vertical direction and operating together with the adjusting screw portion; and a lifting portion which is screwed and coupled with the fastening portion in the main body so as to be lifted up and down, and is formed in a shape corresponding to the shape of the main body to restrict a movement in a rotational direction.

In an embodiment of the multi-link hinge device, the adjustment screw portion is provided along an outer circumferential surface in a state where the fastening portion is screwed and coupled to form a plurality of adjustment grooves continuously, and wherein the lifting portion is formed to adjust an elastic force of the elastic member by lifting from the inside of the main body by inserting a rotary tool into a through hole provided on the outside of the first link and rotating the adjustment groove.

In a further embodiment of the multi-link hinge device further includes a damper unit hinged to the bottom lever and configured to applying a damping force to the body lever when the top lever is operated.

In an embodiment of the multi-link hinge device, the damper unit includes: a cylinder tube rotatably connected to the bottom lever to store fluid therein; a piston accommodated to be slidably moved by a fluid in the cylinder tube to apply a damping force to the body lever;

a piston rod connected to have a length to the piston and extended out of the cylinder tube to be rotatably connected to the body lever; and a cylinder head for slidingly supporting the piston rod with respect to the cylinder tube.

In an embodiment of the multi-link hinge device, the cylinder tube includes: an opening section for allowing the fluid located on the cylinder head side to be moved through a first outlet as the door moves from an opening position to a closing position; a soft closing section starting from a point where the first outlet is completely closed by the piston and gradually moving the piston to the piston rod side by moving the body lever in a state where a movement of the fluid is blocked; and a closing section for allowing the remaining fluid located on the cylinder head side to move toward the soft closing section side through a second outlet as the door is positioned at the closing position.

In an embodiment of the multi-link hinge device, the first outlet and the second outlet are provided with a plurality of intervals along the inner peripheral surface of the cylinder tube of the opening section and the closing section.

In an embodiment of the multi-link hinge device, the first outlet is formed to have a different length in which the plurality of lengths toward the soft closing section is gradually lengthened so that the movement of the fluid is sequentially blocked as the piston moves from the opening section to the soft closing section.

In an embodiment of the multi-link hinge device, the piston includes: a body portion disposed in contact with an inner surface of the cylinder tube and having an annular receiving groove formed on an outer circumferential surface for inserting a seal ring; and a fluid moving portion provided in the body portion to form a fluid flow path, the fluid being formed to be moved through the fluid flow path when the body portion moves along the soft closing section in a state sealed in the cylinder tube.

As described above, according to the present invention, any one of a plurality of links connecting the plurality of levers to each other may serve as a link and at the same time serve as a cover. Therefore, the present invention can block a finger or the like from being caught in a space between the plurality of levers when the door is opened or closed and accordingly, thereby having an effect of preventing the user's injury due to the multi-link structure in advance.

Further, according to the present invention, a body lever may be provided with a cam member, and the cam member may be positioned to interact with a roller member provided on a rocker arm, wherein the rocker arm may press the roller member against the cam member under an elastic action, and a multi-link may be pushed to a closing position or an opening position along the constant velocity section and the acceleration section, thereby having an effect of enabling easy opening and closing of the door.

Further, according to the present invention, a plurality of oil outlets may be installed along the outer circumferential surface of one end of the cylinder member constituting the fluid damper, and the plurality of oil outlets may be arranged with different heights, thereby having an effect of providing a gradual damping force towards the door moving to the closing position before the soft closing is made.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Hereinafter, the exemplary embodiments of the present invention will be described in detail with reference to the accompanying drawings.

Advantages and features of the present invention and a method of achieving the same will be apparent with reference to the embodiments described below in detail together with the accompanying drawings.

However, the present invention is not limited by the embodiments disclosed below, but will be implemented in various forms. In addition, the present embodiments are merely intended to complete the present invention of the present invention, and provided to fully inform the scope of the invention to those skilled in the art to which the present invention pertains. Accordingly, the present invention may be only defined by the scope of the claims.

In addition, in the following description of the present invention, if it is determined that related well-known technologies and the like may obscure the subject matter of the present invention, the detailed description thereof will be omitted.

Figure 1:
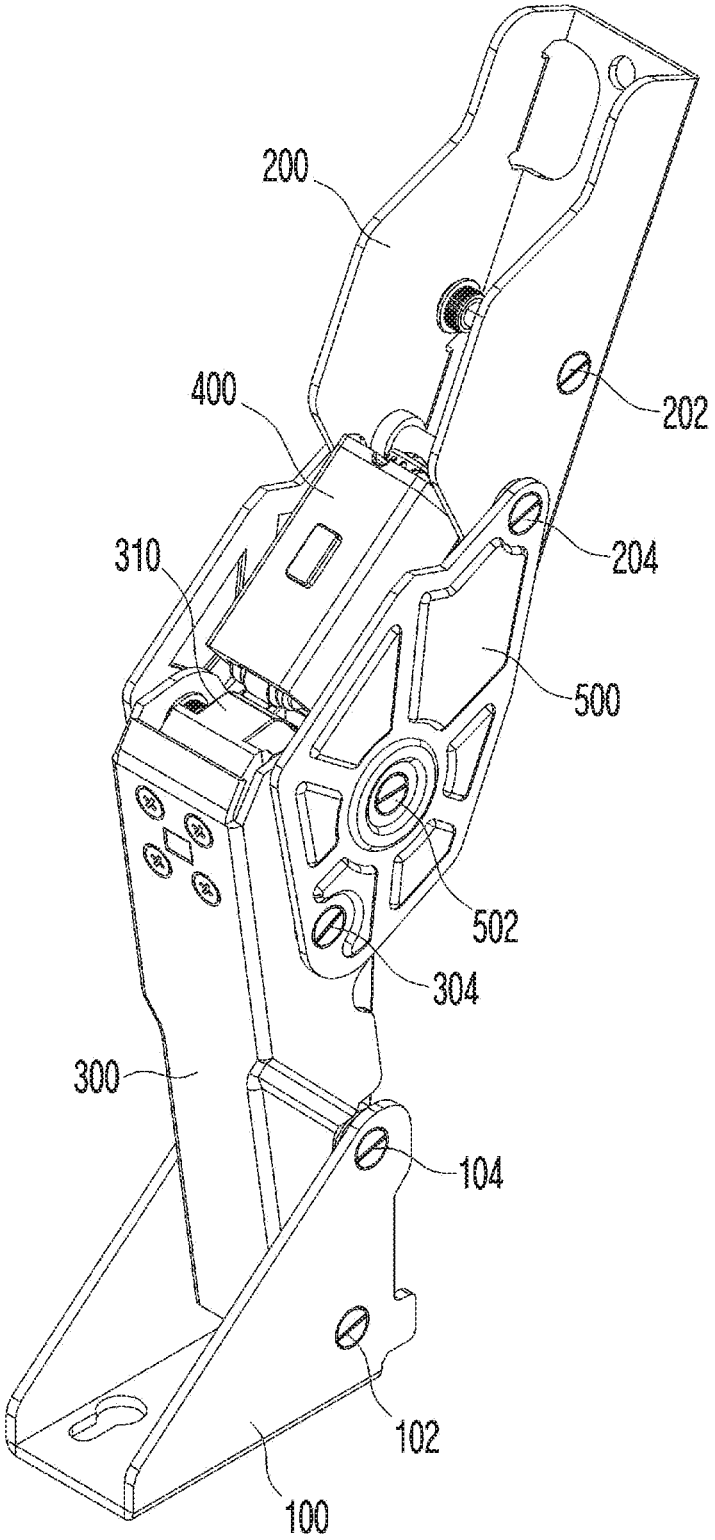
FIG. 1 is a view schematically showing a multi-link hinge device according to an embodiment of the present invention.
Figure 2:
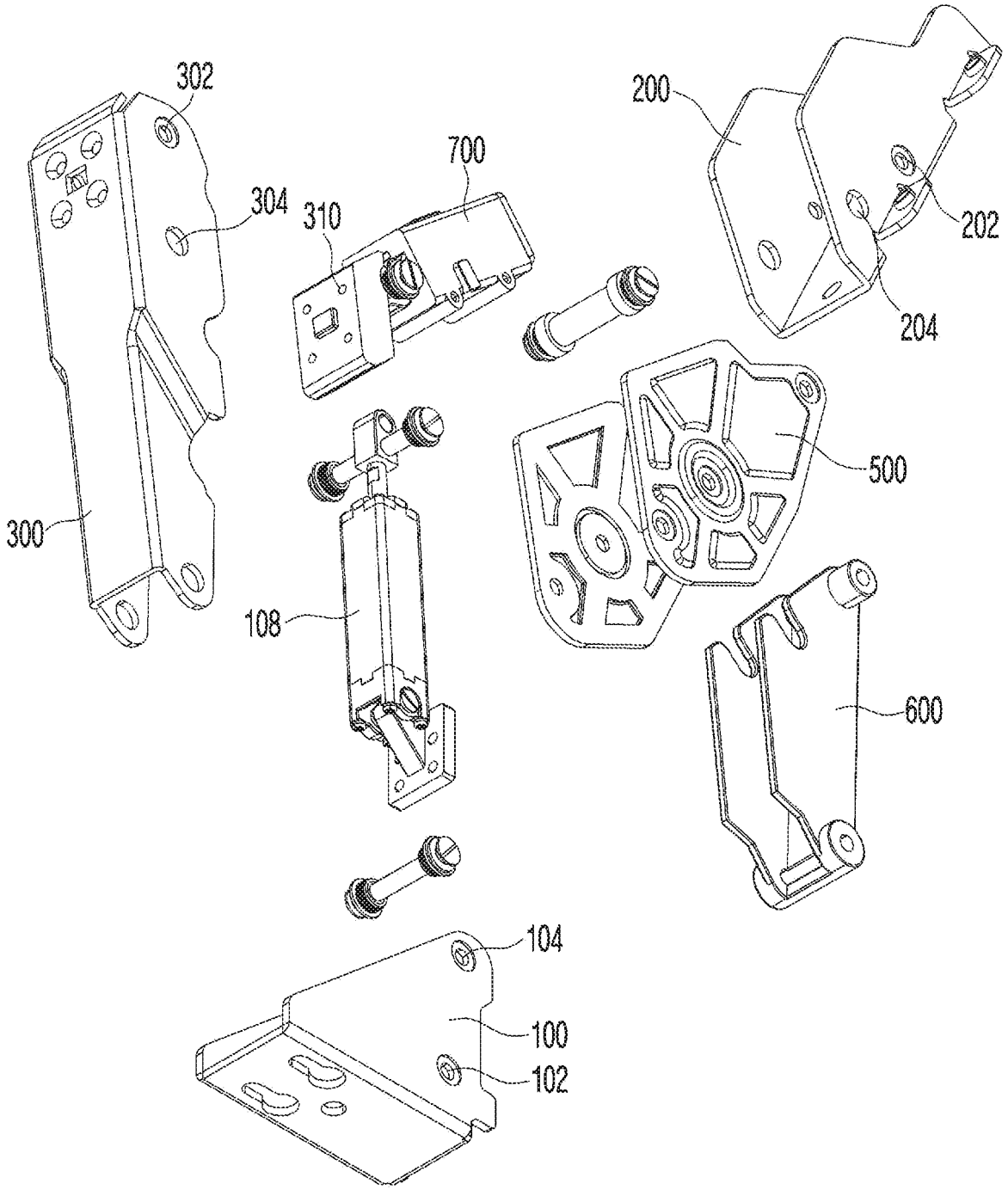
FIG. 2 is a diagram illustrating a configuration of the multi-link hinge device according to an embodiment of the present invention.

FIG. 1 is a view schematically showing a multi-link hinge device according to an embodiment of the present invention, and FIG. 2 is a diagram illustrating a configuration of the multi-link hinge device according to an embodiment of the present invention.

As shown in FIGS. 1 and 2, the multi-link hinge device according to the present embodiment may include a bottom lever 100, a top lever 200, a body lever 300, a first link 400, a second link 500 and a third link 600.

Herein, the member in which a plurality of levers and links 100, 200, 300, 400, 500, and 600 are coupled may be configured such that members such as home appliances and furniture provided with a door, that is, a plurality of members arranged in a built-in form are rotatably connected to each other so that the door can be easily rotated from the open position to the closing position or from the closing position to the open position even in a narrow space. The configuration of the plurality of levers and links 100, 200, 300, 400, 500, and 600 will be described below.

First at all, the bottom lever 100 is installed on the main body of the member with a door, and has a first bottom fastening hole 102 and a second bottom fastening hole 104 formed to be spaced apart from the end side thereof.

The top lever 200 is installed in the door that opens and closes the front of the main body as described above, and has a first top fastening hole 202 and a second top fastening hole 204 spaced apart from each other.

The body lever 300 is pivotally connected at one end to the first bottom fastening hole 102 and has a first body fastening hole 302 formed at the other end and a second body fastening hole 304 formed at the inner side thereof.

In addition, the first link 400 is pivotally connected to the first top fastening hole 202 and the first body fastening hole 302.

Further, the second link 500 is pivotally connected to the second top fastening hole 204 and the second body fastening hole 304 and has a link center fastening hole 502 formed therein.

In addition, the second link 500 is pivotally connected to the second top fastening hole 204 and the second body fastening hole 304 at the outside of the top lever 200 and the body lever 300, and formed to have a predetermined size to cover an area spaced apart from the first link 400 from the outside.

In other words, although not shown in the drawings, the conventional second link 500 has a predetermined size, more specifically, a size and a length corresponding to the first link 400 and serves only as a link connecting the top lever 200 and the body lever 300, which results in producing an area spaced apart from the first link 400.

In this case, when the user's finger or the like is inserted into the spaced area generated as described above, since the top lever 200, the body lever 300, the first link 400 and the second link 500 are in the form of scissors, a large injury such as a finger cut may be caused at the time when the door moves from the open position to the closing position.

Therefore, in the present embodiment, the second link 500 serves as a general link and at the same time, may be formed in a predetermined size to cover the spaced area from the outside. Accordingly, it is possible to prevent the user's finger or the like from being caught in the spaced area when the door is opened or closed, thereby preventing the user from being injured due to the multi-link structure in advance.

Preferably, as the door moves from the open position to the closing position, the second link 500 may be formed in a polygonal shape so that the spaced area continuously generated between the top lever 200, the body lever 300, and the first link 400 may be effectively covered. Such a shape set forth above may be variously designed to be effectively covered.

Meanwhile, the third link 600 is pivotally connected to the link center fastening hole 502 and the second bottom fastening hole 104.

Figure 3:
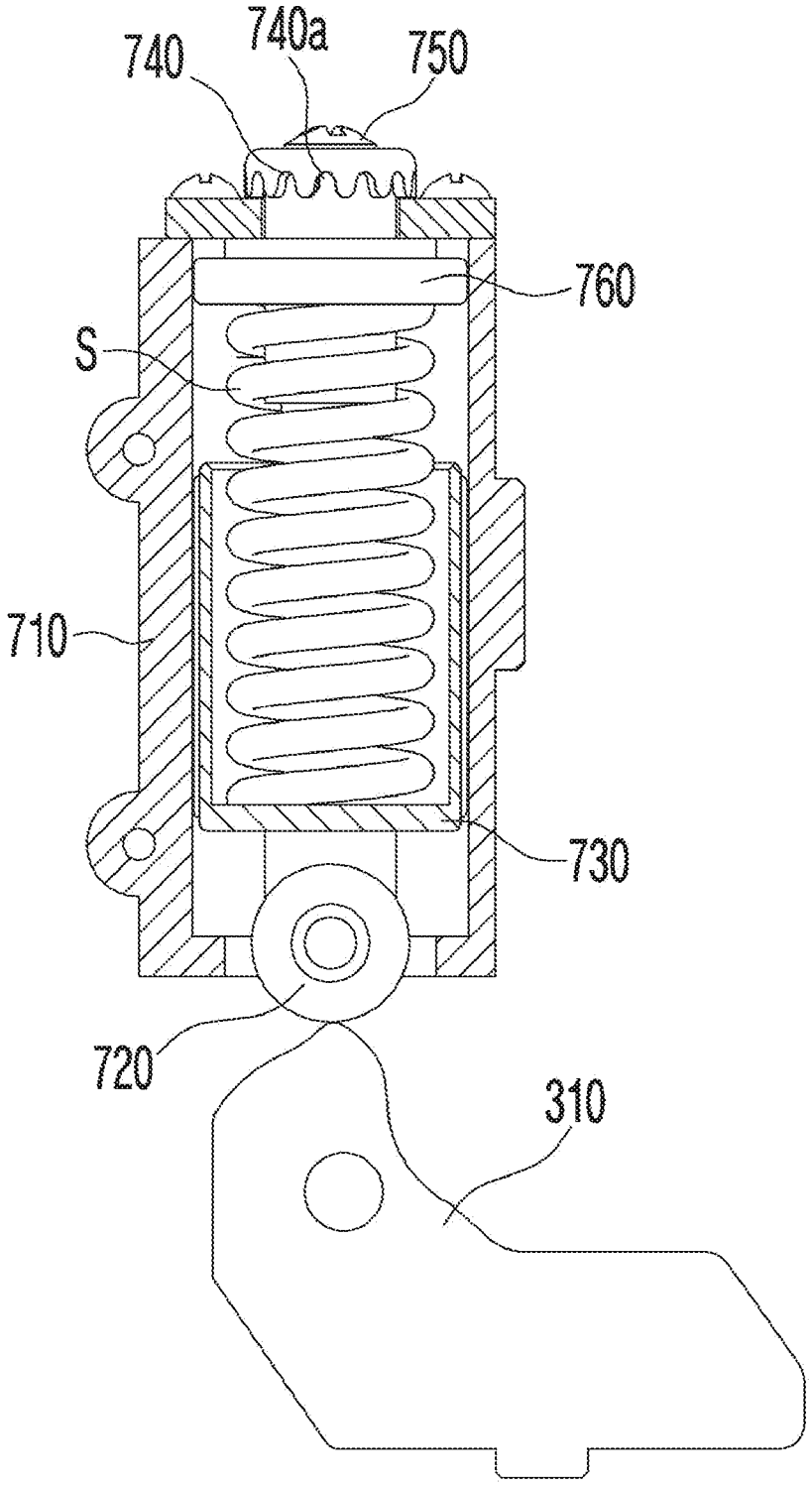
FIG. 3 is a view showing the configuration of a rocker arm and a cam member for the multi-link hinge device according to an embodiment of the present invention.
Figure 4:
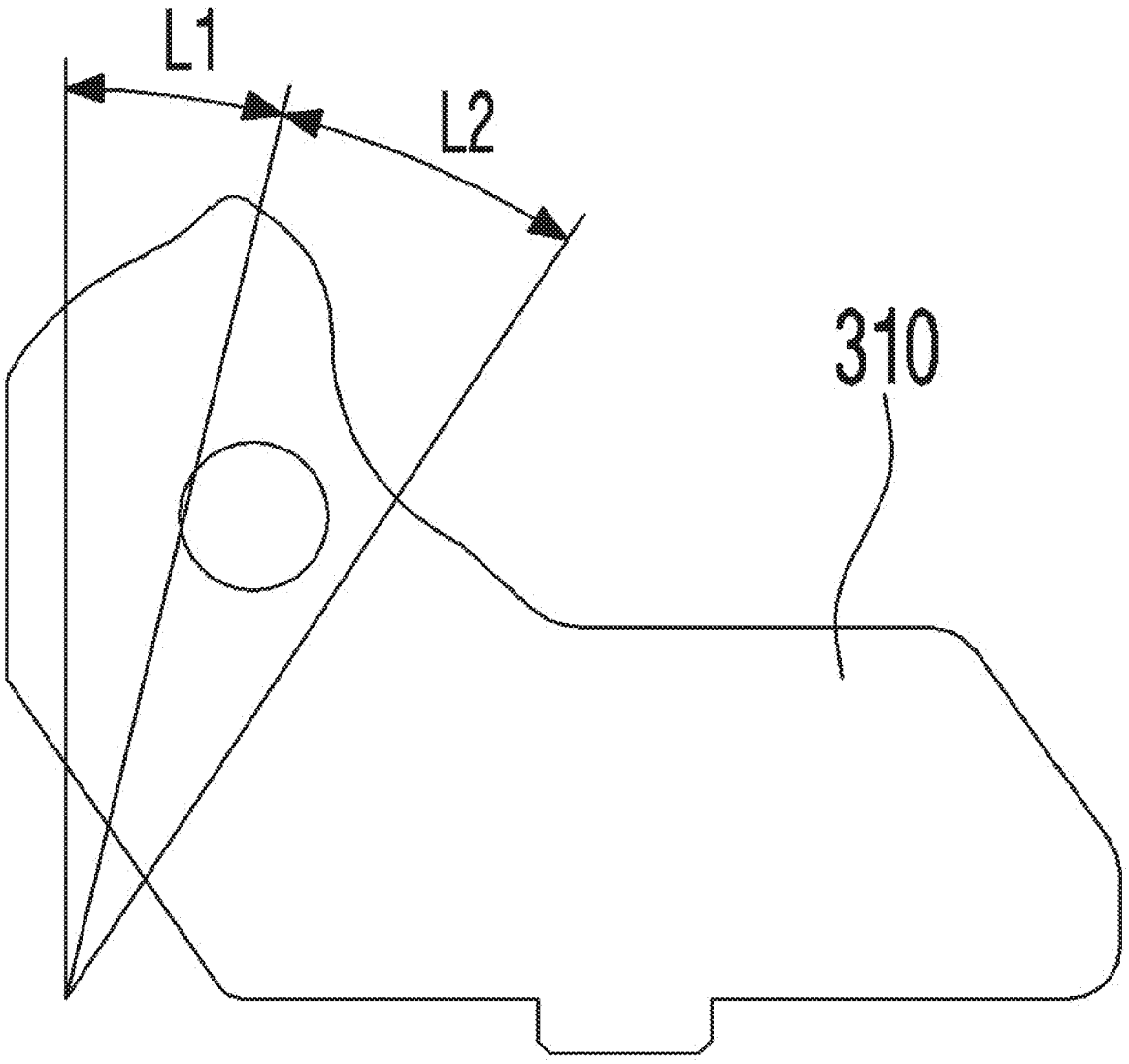
FIG. 4 is a view showing a constant velocity section and an acceleration section of the cam member for the multi-link hinge device according to an embodiment of the present invention.
Figure 5:
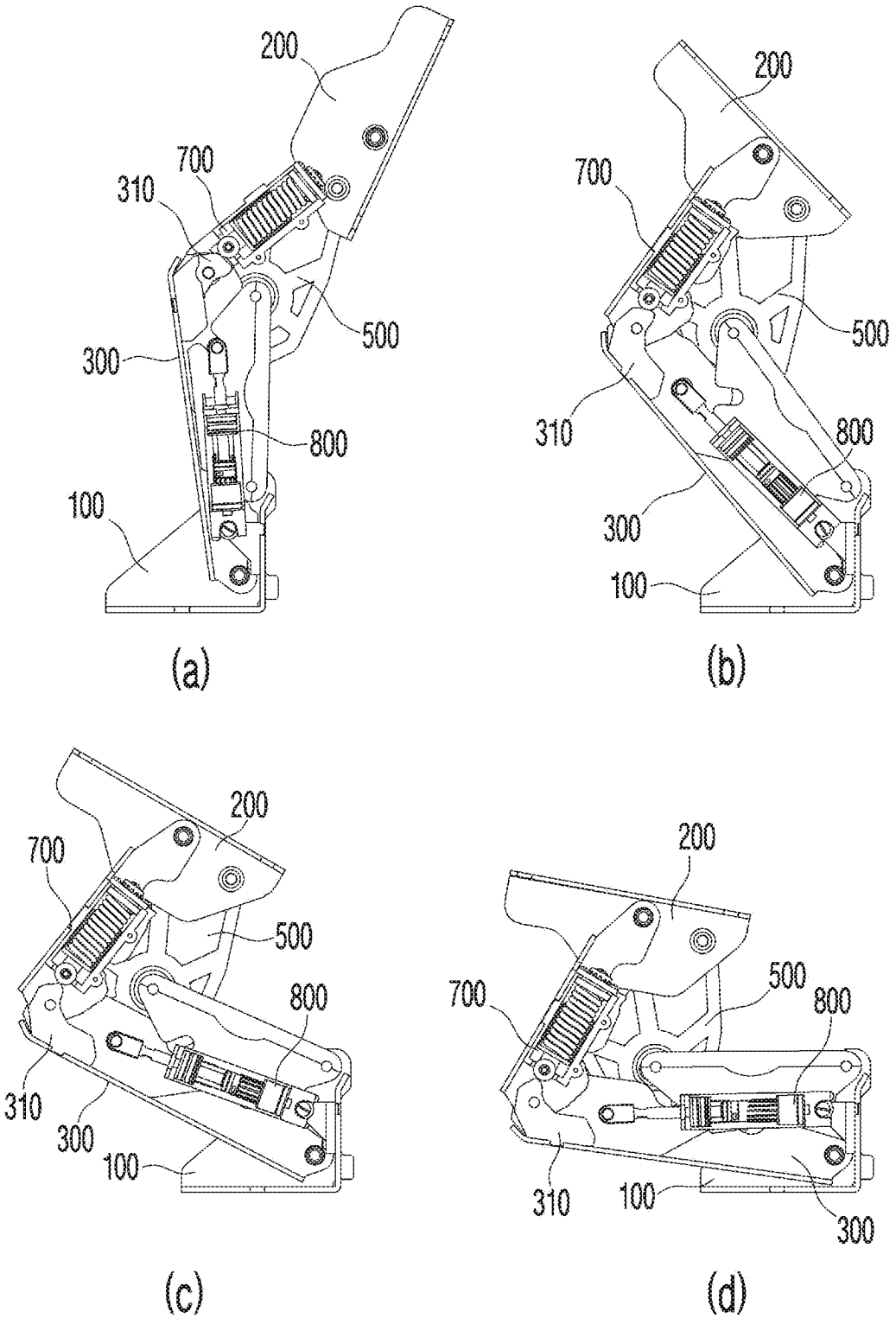
FIG. 5 is a diagram illustrating an operation of the multi-link hinge device according to an embodiment of the present invention.

Hereinafter, FIG. 3 is a view showing the configuration of a rocker arm and a cam member for the multi-link hinge device according to an embodiment of the present invention, FIG. 4 is a view showing a constant velocity section and an acceleration section of the cam member for the multi-link hinge device according to an embodiment of the present invention, and FIG. 5 is a diagram illustrating an operation of the multi-link hinge device according to an embodiment of the present invention.

As shown in FIG. 3, the multi-link hinge device according to the present embodiment may be installed between the top lever 200 and the first link 400. In addition, the multi-link hinge device may further include a rocker arm 700 for guiding the top lever 200 to move to a closing position or an open position along a constant velocity section and an acceleration section when the top lever 200 opens and closes the door.

To this end, the rocker arm 700 has a main body 710, a roller member 720, and a pressing member 730.

The main body 710 is coupled to the inside of the first link 400 so as not to be exposed to the outside, and has a receiving area therein.

In addition, the roller member 720 is formed to protrude at the end of the main body 710 to press the cam member 310 provided in the body lever 300.

In other words, the body lever 300 may be provided with the cam lever 310, and the cam member 310 may be positioned to interact with the roller member 720, so that the roller member 720 may be pressed against the cam member 310 under the elastic action by the elastic member S. Accordingly, the door may be pushed to a closing or open position along the constant velocity section L1 and the acceleration section L2.

In this regard, for example, as the angle of the first link 400 with respect to the body lever 300 rotated to be moved from the open position to the closing position is variable (rotated), the cam member 310 is fixedly coupled to the body lever 300 such that an area facing the roller member 720 is changed into the constant velocity section L1 or the acceleration section L2.

That is, as shown in FIGS. 4 and 5, the cam member 310 may be radially formed, and formed to have the constant velocity section L1 formed in a round shape and the acceleration section L2 formed in a bent shape in a constant velocity section L1. Accordingly, when the door starts to move from the open position (FIG. 5*a*) to the closing position, if the roller member 720 moves at a relatively slow speed along the constant velocity section L1 and reaches a predetermined position at which closing starts (FIG. 5*d*), the roller member 720 moves along the acceleration section L2 at a high speed, so that the door can be easily moved to the closing position without applying a large force.

Meanwhile, the pressing member 730 may be connected to the roller member 720, and may have one end connected to the roller member 720 and the other end provided in a U-shape in the receiving region provided in the main body 710 to accommodate the elastic member S therein. Accordingly, the roller member 720 may be provided to elastically pressurize the cam member 310 by an elastic force of the elastic member S.

Figure 6:
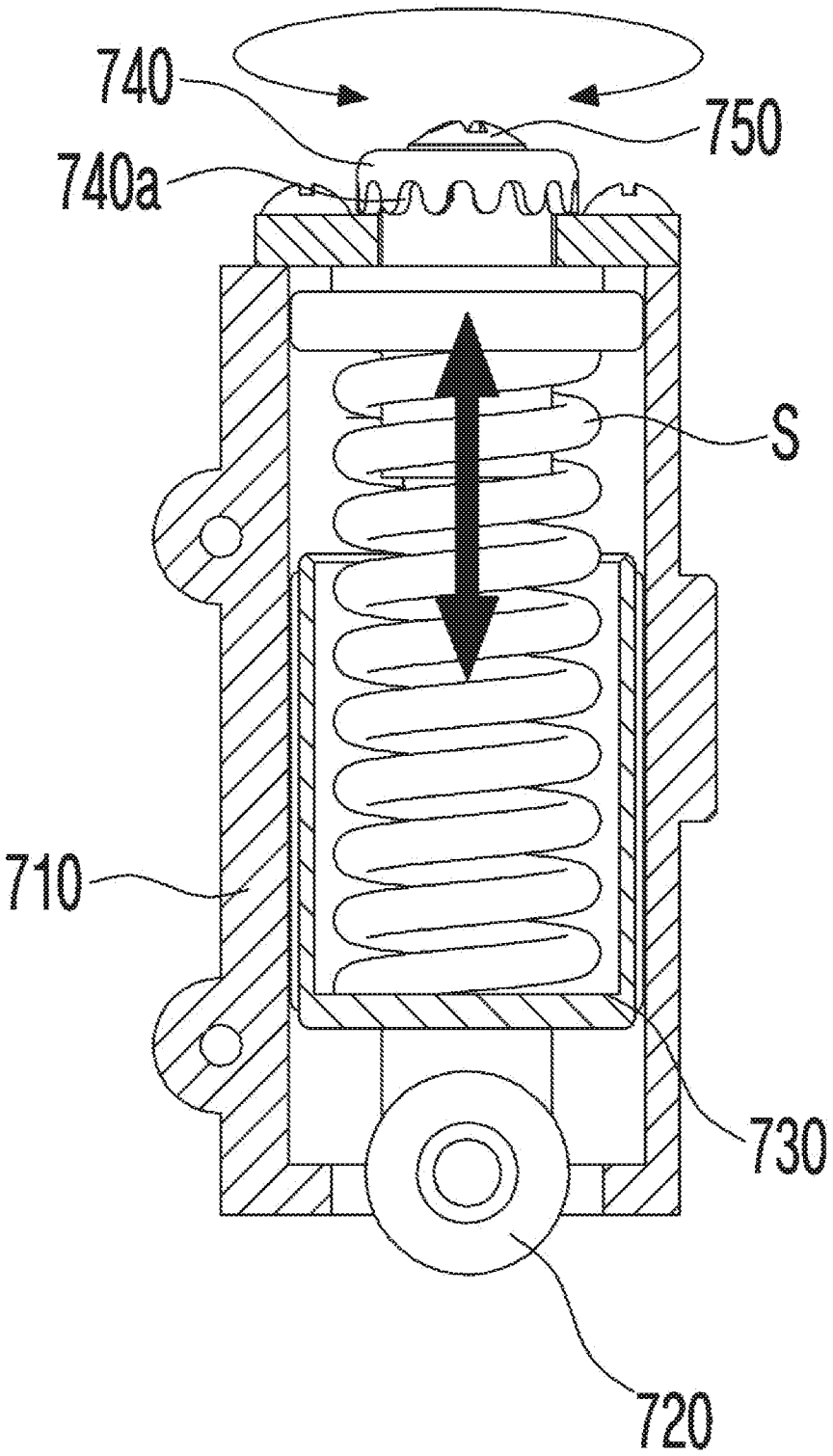
FIG. 6 is a view showing a tension adjustment of an elastic member for the multi-link hinge device according to an embodiment of the present invention.

Hereinafter, FIG. 6 is a view showing a tension adjustment of an elastic member for the multi-link hinge device according to an embodiment of the present invention;

As shown in FIG. 6, the multi-link hinge device according to the present embodiment may further include a rocker arm 700, and the rocker arm 700 may further include an adjusting screw portion 740, a fastening portion 750, and a lifting portion 760.

First, the adjustment screw portion 740 is rotatably arranged and coupled to surround the upper surface of the main body 710 and formed to restrain a movement in the lifting direction.

Thus, the adjustment screw portion 740 is only capable of rotating, such as an idling operation in a state coupled to penetrate the upper surface of the main body 710. Further, the upper surface of the main body 710 is surrounded in a form in which the adjustment screw portion 740 is surrounded up and down, such that the movement in the up and down direction of the adjustment screw portion 740 is restricted.

In addition, the fastening portion 750 may be coupled to the adjusting screw portion 740 and may be positioned in the main body 710 by penetrating the adjusting screw portion 740 in a vertical direction.

The fastening portion 750 may be formed with a screw thread on an outer circumferential surface, and may be integrally coupled to the adjusting screw portion 740, so that the fastening portion 750 may operate together with the adjusting screw portion 740.

Preferably, the fastening portion 750 may be formed of a bolt.

The lifting portion 760 may be screwed with the fastening part 750 in the main body 710 to be arranged to be lifted, and may be formed to have an outer circumferential surface of a shape corresponding to the shape of the main body 710, that is, a quadrangle to restrain the movement in the rotational direction.

Preferably, the lifting portion 760 may be formed of a nut.

Here, as the rotary tool (not shown) may be inserted into a through hole (not shown) provided on the outside of the first link 400 and the adjustment groove 740*a* of the adjustment screw portion 740 may be rotatably moved, the lifting portion 760 may adjust the elastic force of the elastic member S by being lifted in the main body 710.

That is, the adjustment screw portion 740 may be provided along the outer circumferential surface of the upper portion protruding to the outside of the main body 710 in a state where the fastening portion 750 is inserted therein and in a form in which the adjustment groove 740*a* is continuously arranged like a wave pattern.

Here, in a state where a rotary tool (not shown) made of a flat-blade screwdriver or the like is inserted into a through hole (not shown) provided outside the first link 400, and an end thereof is positioned inside the adjustment groove 740*a*, when the lifting portion 760 is moved by pushing the adjustment groove 740*a* in one direction through the rotation and pressing of the rotary tool (not shown), the adjustment screw portion 740 is only made of rotation, but idle rotation in the main body 710. In this case, when the adjustment screw portion 740 is rotated, the rotational force is transferred to the lifting portion 760 screwed with the adjustment screw portion 740 in the main body 710 so as to perform the lifting, so that the lifting portion 760 may selectively adjust the elastic force by pressing or relaxing the elastic member S by being lifted in the main body 710.

Therefore, the rocker arm 700 according to the present embodiment can easily adjust the elastic force of the elastic member S from the outside by a rotary tool (not shown) through the configuration of the adjustment screw portion 740, the fastening portion 750 and the lifting portion 760 as described above, without separating the multi-link structure separately. Accordingly, the pressing force of the roller member 720 with respect to the cam member 310 may be adjusted, so that the roller member 720 may adjust the force passing through the constant velocity section L1 and the acceleration section L2 of the cam member 310 to effectively control the moving speed of the door.

Figure 7:
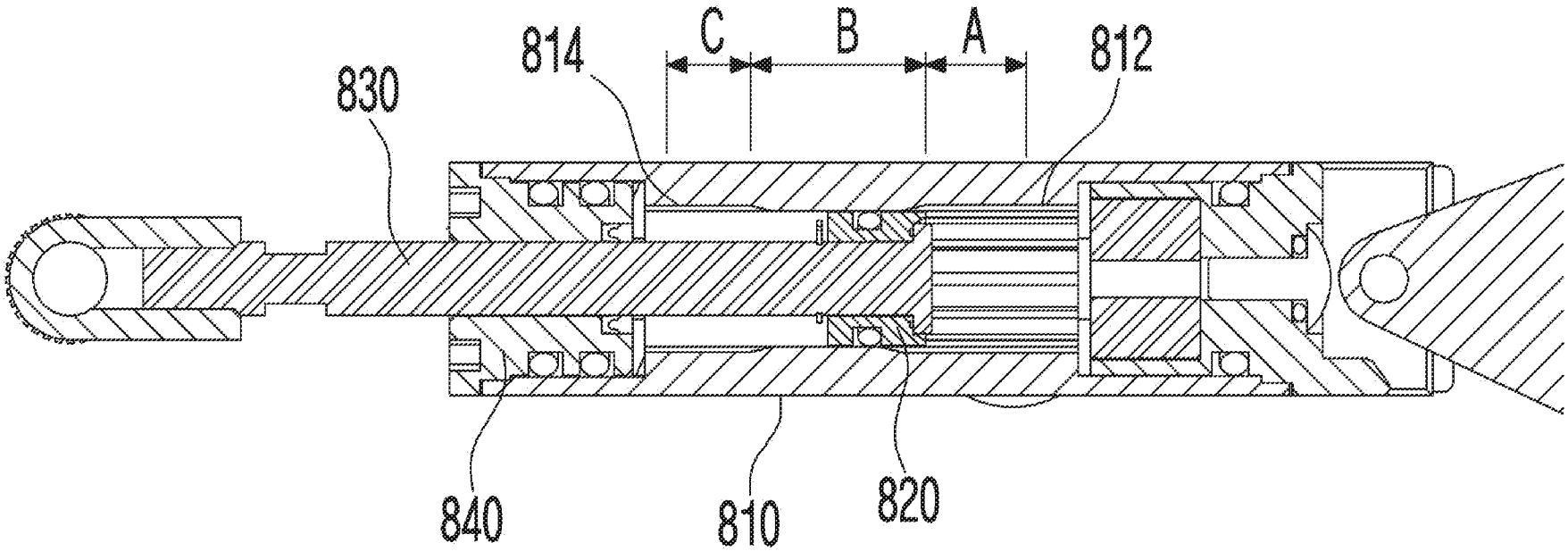
FIG. 7 is a view showing a damper unit for the multi-link device according to an embodiment of the present invention.
Figure 8:
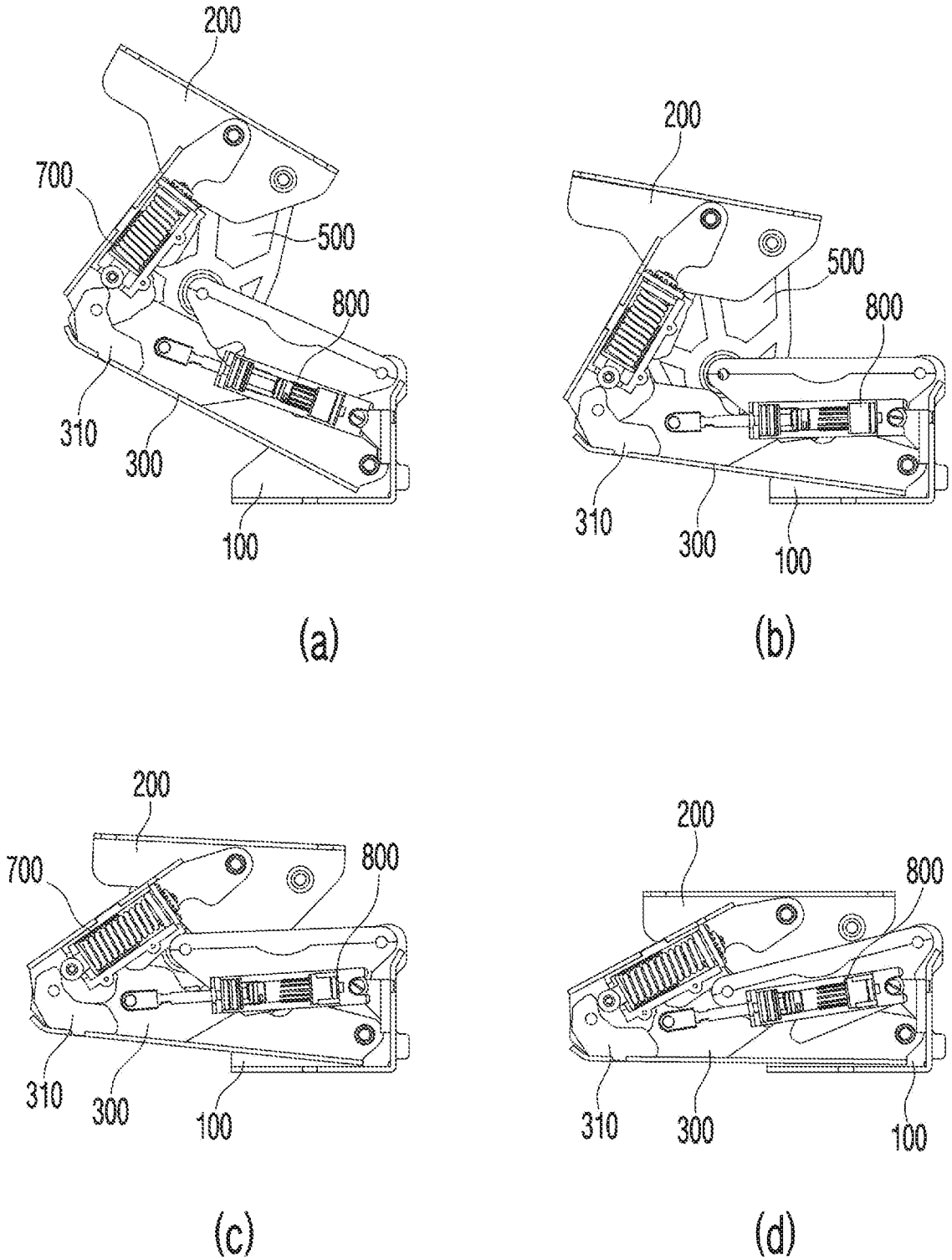
FIG. 8 is a view showing an operation of the damper unit for the multi-link device according to an embodiment of the present invention.

Hereinafter, FIG. 7 is a view showing a damper unit for the multi-link device according to an embodiment of the present invention, and FIG. 8 is a view showing an operation of the damper unit for the multi-link device according to an embodiment of the present invention.

Figure 9:
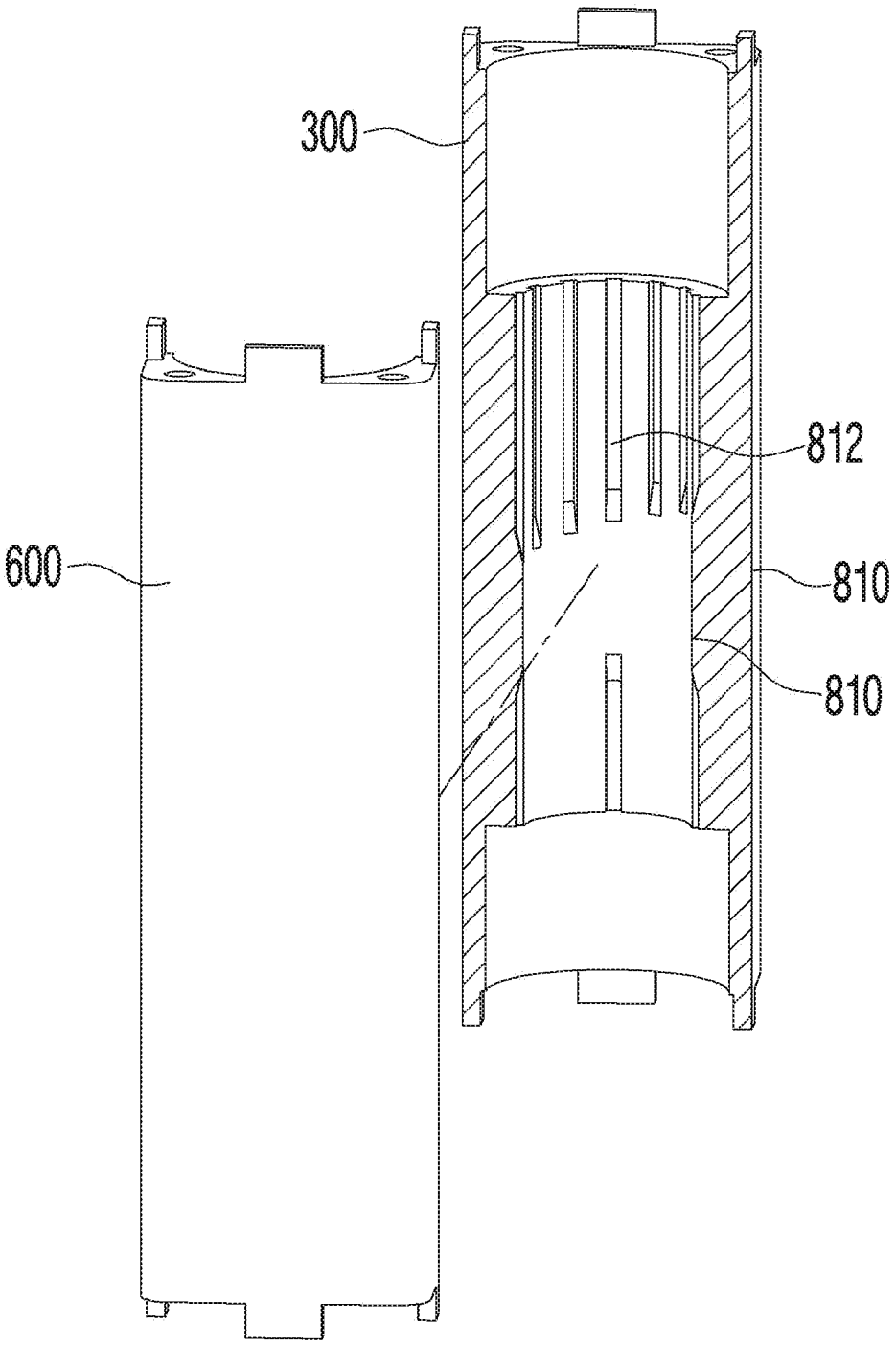
FIG. 9 is a view showing a first outlet of the damper unit for the multi-link device according to an embodiment of the present invention.
Figure 10:
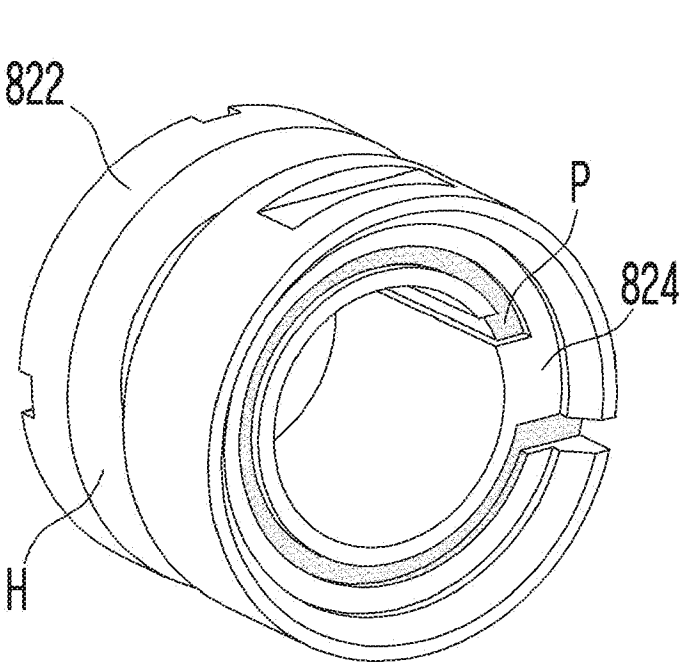
FIG. 10 is a view showing the structure of a piston for the multi-link device according to an embodiment of the present invention.
Figure 10:
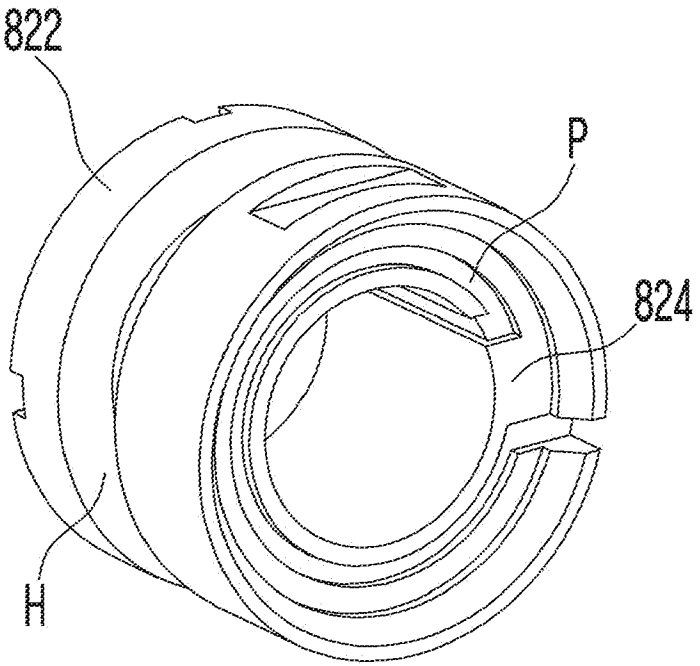

In addition, FIG. 9 is a view showing a first outlet of the damper unit for the multi-link device according to an embodiment of the present invention, and FIG. 10 is a view showing the structure of a piston for the multi-link device according to an embodiment of the present invention.

As shown in FIG. 7, the multi-link hinge device according to the present embodiment may further include a damper unit 800, and the damper unit 800 may include a cylinder tube 810, a piston 820, a piston rod 830, and a cylinder head 840.

First, the cylinder tube 810 may be rotatably connected to the bottom lever 100 and the body lever 300 to store fluid therein.

In addition, the piston 820 may be accommodated to be slidably moved by the fluid in the cylinder tube 810 and may be formed to apply a damping force to the body lever 300.

The piston 820 may include a body portion 822 and a fluid moving portion 824 to be movable by the fluid in a state sealed in the cylinder tube 810.

The body portion 822 may be disposed in contact with the inner surface of the cylinder tube 810, and an annular receiving groove H for inserting the seal ring may be formed on the outer circumferential surface.

In the body portion 822, when the piston rod 830 is pulled out of the cylinder tube 810 as the door moves to the closing position, or when the piston rod 830 is pushed into the cylinder tube 810 as the door moves to the open position, the fluid may move through a first outlet 812 or a second outlet 814, respectively. Accordingly, the door can be freely moved, but the movement of the fluid may be completely blocked in a soft closing section B. In other words, the first outlet 812 may be gradually increased in resistance due to the movement of the door from the last part of the opening section A which is mostly shielded, and may be completely sealed in the soft closing section B, thereby making it impossible to move the fluid. As a result, the resistance of the door may be generated 100% in the soft closing section B.

Therefore, the piston 820 in the soft closing section B has a fluid moving portion 824 therein to enable the soft closing function to be operated when the piston rod 830 is pulled out of the cylinder tube 810 as the door moves to the closing position. Since the fluid moving portion 824 may be formed with a fluid flow path P having a predetermined width as shown in FIG. 10*a*, even when the body portion 822 moves along the soft closing section B in a completely closed state in the cylinder tube 810, the fluid may move only through the fluid flow path P, as shown in FIG. 10*b*, so that the door moving to the closing position causes the soft closing function to be activated.

In addition, the piston rod 830 may be connected to have a length to the piston 820 and extended out of the cylinder tube 810 to be rotatably connected to the body lever 300.

The cylinder head 840 may slidably support the piston rod 830 with respect to the cylinder tube 810.

Meanwhile, the cylinder tube 810 may include of an opening section A, a soft closing section B, and a closing section C as shown in FIG. 7.

The opening section A may be a section in which the door can freely move and may be a section in which the fluid located at the cylinder head 840 side may be moved through the plurality of first outlets 812, as the door moves from the open position to the closing position, that is, as the roller member 720 moves from the constant velocity section L1 to the acceleration section L2 of the cam member 310, as shown in FIG. 8*a*.

In this regard, in the first outlet 812, the plurality of lengths toward the soft closing section B from the bottom lever 100 side may be formed to have different lengths so that the movement of the fluid may be sequentially blocked as the piston 820 moves from the opening section A to the soft closing section B.

This is to proactively provide a damping force for sequentially blocking the movement of the fluid and reducing the operation speed of the door, before reaching the soft closing section B by forming the lengths of the plurality of first outlets 812 in different lengths as shown in FIG. 9. This is because the movement of the door from the open position to the closing position operates relatively quickly when the fluid located on the cylinder head 840 side moves through the first outlet 812 at a time due to the same length of the plurality of first outlets 812.

The soft closing section B may be a section which starts from the end of the opening section A, that is, a point at which the first outlet 812 is completely closed by the piston 820 and in which the piston 820 gradually moves toward the piston rod 840 by the movement of the body lever 300 in a state where the movement of the fluid is blocked.

That is, as shown in FIGS. 8*b* and 8*c*, when the roller member 720 reaches the acceleration section L2 of the cam member 310, the closing speed of the door also increases. In this case, by positioning the piston 820 at the point where the first outlet 812 is fully closed, that is, at the soft closing section B where the movement of the fluid is blocked, the damping force may be provided to the body lever 300 which moves rapidly, and the closing speed is gradually reduced when the door moves to the closing position, so that the soft closing function may be operated.

The closing section C is a section for allowing the inner fluid to move toward the soft closing section B through a plurality of second outlets 814 as the door is positioned at the closing position, as shown in FIG. 8*d*.

In this case, since the fluid moves to the soft closing section B side at a time through the plurality of second outlets 814 having the same length, the closing function may be operated while the soft closing function may be released, so that the door can be easily closed. In addition, it may also cause the user to feel that the door is smoothly closed.

Accordingly, in the present embodiment, a first damping force may be provided through the first outlet 812 having different lengths when the closing function is operated for the door moving from the open position to the closing position, and a second damping force may be sequentially provided through the soft closing section B to operate the soft closing function. Therefore, it is possible to provide an operational stability when closing the door. At the same time, it is possible to prevent the problem of breakage that may be caused by the collision of the door to the main body in advance.

In addition, in the present embodiment, even in the case of the door moving in the reverse order of the above-mentioned operation, that is, the door moving from the closing position to the open position, the door can be safely opened by allowing the piston 820 to move sequentially along the soft closing section B and the opening section A.

According to the present invention, any one of a plurality of links connecting the plurality of levers to each other may serve as a link and at the same time serve as a cover, thereby blocking a finger or the like from being caught in a space between the plurality of levers when the door is opened or closed. Accordingly, there is an effect that can prevent the user's injury due to the multi-link structure in advance.

Further, according to the present invention, the body lever may be provided with a cam member, and the cam member may be positioned to interact with the roller member provided on the rocker arm, wherein the rocker arm may press the roller member against the cam member under the elastic action, and a multi-link may be pushed to the closing position or the open position along the constant velocity section and the acceleration section. Therefore, the present invention has an effect of enabling easy opening and closing of the door.

Further, according to the present invention, the plurality of oil outlets may be installed along the outer circumferential surface of one end of the cylinder member constituting the fluid damper, and the plurality of oil outlets may be arranged with different heights. Therefore, the present invention has an effect of providing a gradual damping force towards the door moving to the closing position before the soft closing is made.

Although the present invention has been described with reference to the embodiment(s) shown in the drawings, this is merely illustrative, and those skilled in the art can make various modifications therefrom. In addition, it will be appreciated that all or some of the above described embodiment(s) may be optionally combined. Therefore, the true technical protection scope of the present invention should be defined by the technical spirit of the appended claims.

What is claimed is:

1. A multi-link hinge device, comprising:

a bottom lever installed on a main body of a member provided with a door, the bottom lever having a first bottom fastening hole and a second bottom fastening hole spaced apart from each other at an end side thereof;

a top lever installed on the door of the main body, the top lever having a first top fastening hole and a second top fastening hole spaced apart from each other;

a body lever having one end connected to the first bottom fastening hole and having a first body fastening hole formed at the other end and a second body fastening hole formed at an inner side thereof;

a first link pivotally connected to the first top fastening hole and the first body fastening hole;

a second link pivotally connected to the second top fastening hole and the second body fastening hole and having a link center fastening hole formed therein; and a third link pivotally connected to the link center fastening hole and the second bottom fastening hole, wherein the second link is pivotally connected to the second top fastening hole and the second body fastening hole outside the top lever and the body lever, and is formed to have a predetermined size so as to cover an area spaced from the first link from the outside.

2. The multi-link hinge device according to claim 1, wherein the second link is formed in a polygonal shape so as to cover the area between the top lever, the body lever and the first link continuously as the door moves from an open position to a closing position.

3. The multi-link hinge device according to claim 1, further comprising:

a rocker arm installed between the top lever and the first link and guiding the top lever to move to a closing position or an open position along a constant velocity section and an acceleration section when the top lever opens and closes the door.

4. The multi-link hinge device according to claim 3, wherein the rocker arm includes:

a main body coupled to the first link and having a receiving area therein;

a roller member protruding from an end of the main body to press a cam member provided in the body lever; and a pressing member connected to the roller member, the pressing member being provided in the receiving area to accommodate an elastic member, and the roller member being provided to elastically press the cam member.

5. The multi-link hinge device according to claim 4, wherein the cam member is fixedly coupled to the body lever such that an area facing the roller member is changed into a constant velocity section or an acceleration section as an angle of the first link with respect to the body lever is varied.

6. The multi-link hinge device according to claim 4, wherein the rocker arm includes:

an adjusting screw portion coupled to surround the upper and lower surfaces of the main body so as to be rotatable, and configured to restrict a movement in a lifting direction;

a fastening portion coupled to the adjusting screw portion and positioned in the main body by penetrating the adjusting screw portion in a vertical direction and operating together with the adjusting screw portion; and a lifting portion which is screwed and coupled with the fastening portion in the main body so as to be lifted up and down, and is formed in a shape corresponding to the shape of the main body to restrict a movement in a rotational direction.

7. The multi-link hinge device according to claim 6, wherein the adjustment screw portion is provided along an outer circumferential surface in a state where the fastening portion is screwed and coupled to form a plurality of adjustment grooves continuously, and wherein the lifting portion is formed to adjust an elastic force of the elastic member by lifting from the inside of the main body by inserting a rotary tool into a through hole provided on the outside of the first link and rotating the adjustment groove.

8. The multi-link hinge device according to claim 1, further comprising a damper unit hinged to the bottom lever and configured to applying a damping force to the body lever when the top lever is operated.

9. The multi-link hinge device according to claim 8, wherein the damper unit includes:

a cylinder tube rotatably connected to the bottom lever to store fluid therein;

a piston accommodated to be slidably moved by a fluid in the cylinder tube to apply a damping force to the body lever;

a piston rod connected to have a length to the piston and extended out of the cylinder tube to be rotatably connected to the body lever; and a cylinder head for slidingly supporting the piston rod with respect to the cylinder tube.

10. The multi-link hinge device according to claim 9, wherein the cylinder tube includes:

an opening section for allowing the fluid located on the cylinder head side to be moved through a first outlet as the door moves from an opening position to a closing position;

a soft closing section starting from a point where the first outlet is completely closed by the piston and gradually moving the piston to the piston rod side by moving the body lever in a state where a movement of the fluid is blocked; and a closing section for allowing the remaining fluid located on the cylinder head side to move toward the soft closing section side through a second outlet as the door is positioned at the closing position.

11. The multi-link hinge device according to claim 10, wherein the first outlet and the second outlet are provided with a plurality of intervals along the inner peripheral surface of the cylinder tube of the opening section and the closing section.

12. The multi-link hinge device according to claim 11, wherein the first outlet is formed to have a different length in which the plurality of lengths toward the soft closing section is gradually lengthened so that the movement of the fluid is sequentially blocked as the piston moves from the opening section to the soft closing section.

13. The multi-link hinge device according to claim 10, wherein the piston includes:

a body portion disposed in contact with an inner surface of the cylinder tube and having an annular receiving groove formed on an outer circumferential surface for inserting a seal ring; and a fluid moving portion provided in the body portion to form a fluid flow path, the fluid being formed to be moved through the fluid flow path when the body portion moves along the soft closing section in a state sealed in the cylinder tube.

* * * * *